United States Patent [19]

Takenoya et al.

[11] Patent Number: 5,007,357

[45] Date of Patent: Apr. 16, 1991

[54] EMBROIDERING DEVICE FOR A SEWING MACHINE

[75] Inventors: Hideaki Takenoya; Yoshikazu Ebata, both of Tokyo, Japan

[73] Assignee: Janome Sewing Machine Co., Ltd., Tokyo, Japan

[21] Appl. No.: 371,417

[22] Filed: Jun. 26, 1989

[30] Foreign Application Priority Data

Jun. 24, 1988 [JP] Japan ..... 63/154612
Sep. 30, 1988 [JP] Japan ..... 63/244584

[51] Int. Cl.[5] ..... D05B 21/00; D05C 7/04; D05C 9/04

[52] U.S. Cl. ..... 112/103; 112/121.12; 112/308; 112/235

[58] Field of Search ..... 112/73, 77, 78, 102, 112/103, 121.12, 121.15, 151, 235, 236, 303, 308, 311, 459, 461, 462, 157, 443

[56] References Cited

U.S. PATENT DOCUMENTS

| | | | |
|---|---|---|---|
| 875,614 | 12/1907 | Parkes | 112/103 |
| 1,955,689 | 4/1934 | Spencer | 112/308 |
| 3,656,443 | 4/1972 | Ross | 112/235 X |
| 3,680,508 | 8/1972 | Baig et al. | 112/121.12 |
| 4,386,573 | 6/1983 | Davidson et al. | 112/121.12 X |
| 4,434,729 | 3/1984 | Davidson | 112/121.12 |

*Primary Examiner*—Werner H. Schroeder
*Assistant Examiner*—Paul C. Lewis
*Attorney, Agent, or Firm*—Michael J. Striker

[57] ABSTRACT

An embroidering device for a sewing machine includes an embroidering frame and a first driving member to be connected with the feed dog of the sewing machine for driving the embroidering frame in a direction transverse to lateral swinging and vertical reciprocating directions of a needle bar of the sewing machine. A second driving member is connected with the needle bar support for driving the embroidering frame in the lateral swinging direction of the needle bar.

3 Claims, 6 Drawing Sheets

EMBROIDERING DEVICE FOR A SEWING MACHINE

FIELD OF THE INVENTION

The present invention relates to an embroidering device of a sewing machine, and more particularly to an improved embroidering device having fabric expanding means driven in response to right and left movements of a needle and back and forth movements of a fabric feed dog.

BACKGROUND OF THE INVENTION

Big patterns are desirable in embroidering stitchings of the sewing machine. The patterns are produced by cooperation of the right-left movements of the needle and the back-forth movements of the feed dog, and pattern sizes are determined in dependence upon the amount of lateral movement of the needle. Forming of big patterns is difficult, since the lateral amplitude of the needle is limited by crossing conditions of the needle and a loop taker.

There has been a proposal of forming bigger patterns by moving the fabric feed dog in the right-left direction in addition to the right-left movements of the needle. However, at the right-left movements of the feed dog, if the fabric to be stitched is large in size, the amount of movement does not always agree with the lateral feeding amount, and a desired pattern is deformed, and when the fabric is thin, it is easily shrinked.

For producing large patterns, the fabric expanding means is controlled as industrial embroidering machines, but a driving device is cumbersome and complicated.

It is an object of the invention to propose an embroidering device in a sewing machine having conventional right-left movements of the needle and back-forth movements of a fabric feed dog and which is small in size and simple.

SUMMARY OF THE INVENTION

The object of the invention is achieved by providing in a sewing machine for stitching patterns lateral movements of a needle reciprocating vertically, and back and forth movements of a fabric feed dog, an embdroidering device provided with an X-direction driving member for driving fabric expanding means in a direction opposite to a direction of positioning of the needle, and a Y-direction driving member for driving the fabric expanding means in back-forth directions transverse to the direction of movement of the X-direction driving member by driving the fabric feed dog.

The fabric expanding means is moved back and forth by the Y-direction driving member which is driven by the fabric feed dog, and is also driven in a direction opposite to positioning of the needle by means of the X-direction driving member. The total amount of the movement of the needle and the movement of the feed dog is a relative amount of movement with the right-left movements between the needle and the fabric to be stitched.

The present invention both as to its construction so to its mode of operation, together with additional objects and advantages thereof, will be best understood from the following description of preferred embodiment with reference to the appended drawings.

DETAILED DESCRIPTION OF PREFERED EMBODIMENTS

An embodiment of the invention will be explained in detail with reference to the attached drawings.

Figure 6:
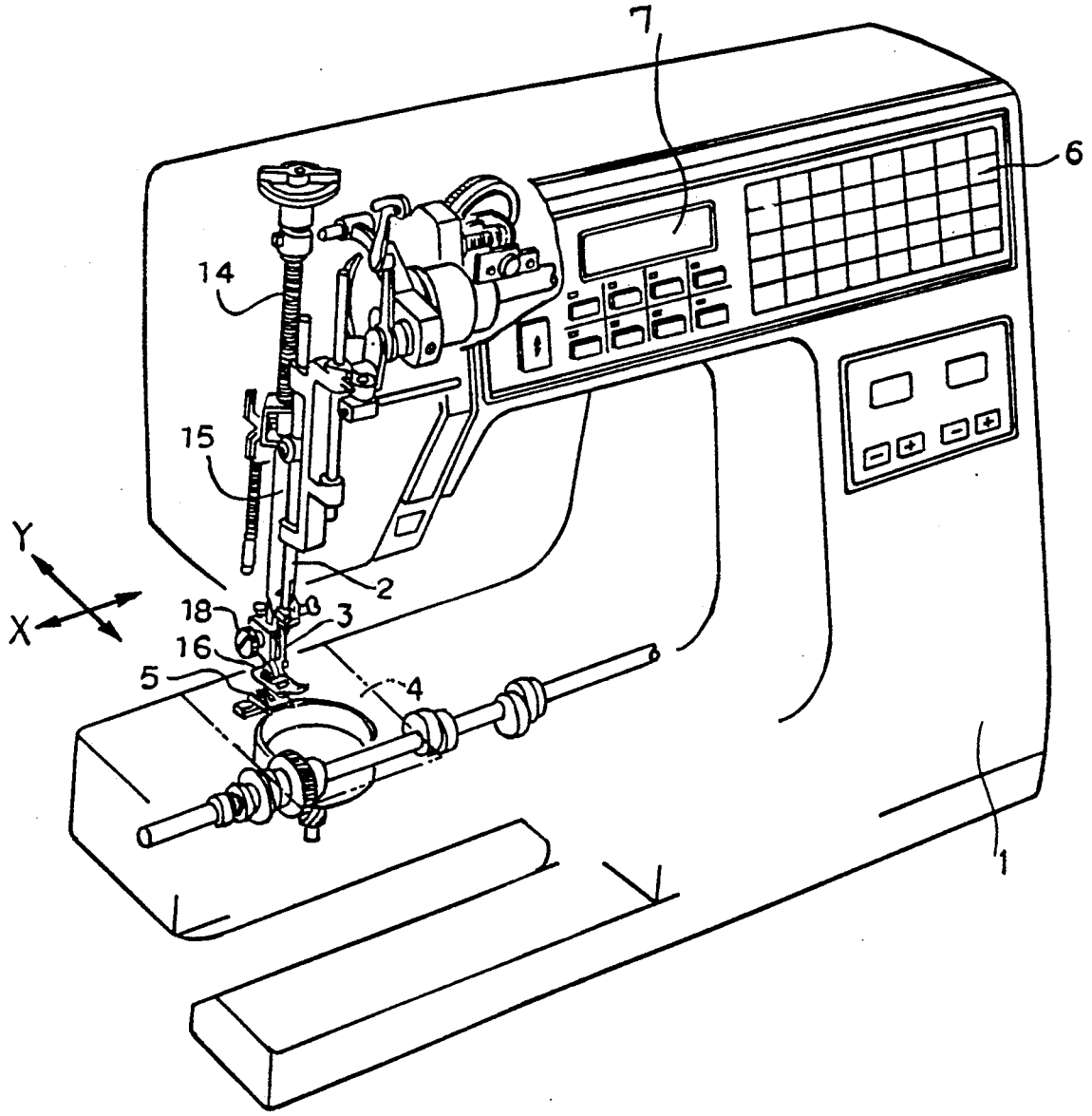
FIG. 6 is a perspective view of a sewing machine with the embroidering device of the invention.

FIG. 6 shows a perspective view of a sewing machine attachable with an embroidering device according to the invention, and an explanation will be made with reference with FIG. 1.

A machine frame 1 is provided with a needle bar 2 which reciprocates vertically and moves laterally, and holds a needle 3 at its end portion.

A needle plate 4 having a needle dropping hole 4*a* is fixed in the machine frame. The needle plate 4 is formed with a groove 4*b* for actuating a fabric feed dog 5 driven in the back-forth directions Y transverse to the right-left directions X of the needle 3. The needle bar 2 is connected, via connecting means, to a needle bar amplitude stepping motor (not shown) incorporated in the machine frame 1. The amount of the back-forth movement of the fabric feed dog 5 is adjusted by an adjuster which is connected, via connecting means, to a feed adjusting stepping motor (not shown) incorporated in the machine frame.

The reference numeral 6 denotes a pattern selecting key means, and the reference numeral 7 denotes an indicating means including LCD for showing a pattern selected by the pattern selecting key means 6.

Drive mechanisms of the needle bar 2 and the fabric feed dog 5 are the same as shown in Japanese Patent Laid-Open Application No. 56-89291 of the same assignee.

The embroidering device of the invention will be explained with reference to FIGS. 1 and 2.

The needle plate 4 is formed with an oblong needle dropping hole 4*a* along the needle amplitude direction (X-direction), a feed dog groove 4*b*, a center 4*c*, and front and rear sides 4*d*, 4*e*.

The feed dog 5 is so formed as to be engaged with the feed groove 4*b*. The needle dropping plate 4 is formed with a pin hole 4*f* and a screw hole 4*g*.

A small needle guide plate 8 is formed with a needle guide dropping hole 8*a* corresponding to the needle dropping hole 4*a*, and a feed dog groove 8*b* corresponding to the center 4*c*, and is implanted on the rear side with a pin 8*c* to fit into the pin hole 4*f*. The small needle guide plate 8 is secured by a screw 9 at a position where the pin 8*c* is engaged with the pin hole 4*f* and the needle hole 8*a* coincides with needle hole 4*a*. Both sides of the plate 8 are so formed as to correspond to the inner sides of feed grooves 4*d*, 4*e* of the needle plate 4 (See FIG. 2).

A Y-direction drive member 10 has elevation parts 10*b*, 10*c* bent inwardly to form a square at both ends of a flat part 10*a*. The flat part 10*a* has a long groove 10*d* for receiving the outer sides of the small needle guide plate 8 in order to move it in the Y-direction transverse to the amplitude direction (X-direction). Therefore, both sides of the long groove 10*d* are positioned on both sides of the fabric feed dog 5 in order to move in the same direction as the latter.

The reference numeral 11 denotes a lower frame having an opening 11*a*, and ends 11*b*, 11*c* wich fit into elevation parts 10*b*, 10*c* of the Y-direction driving member 10. The lower frame 11 is formed with a guide 11*d* for supporting the fabric 13 relative to an upper frame 12.

FIG. 6 shows that a presser bar 15, which is normally biased downward by a compression spring 14, is supported on the machine frame 1 operatively at upper and lower ends thereof. The presser bar 15 is formed with a screw end at its lower part for securing a fabric presser 16 by a screw 18.

Figure 1:
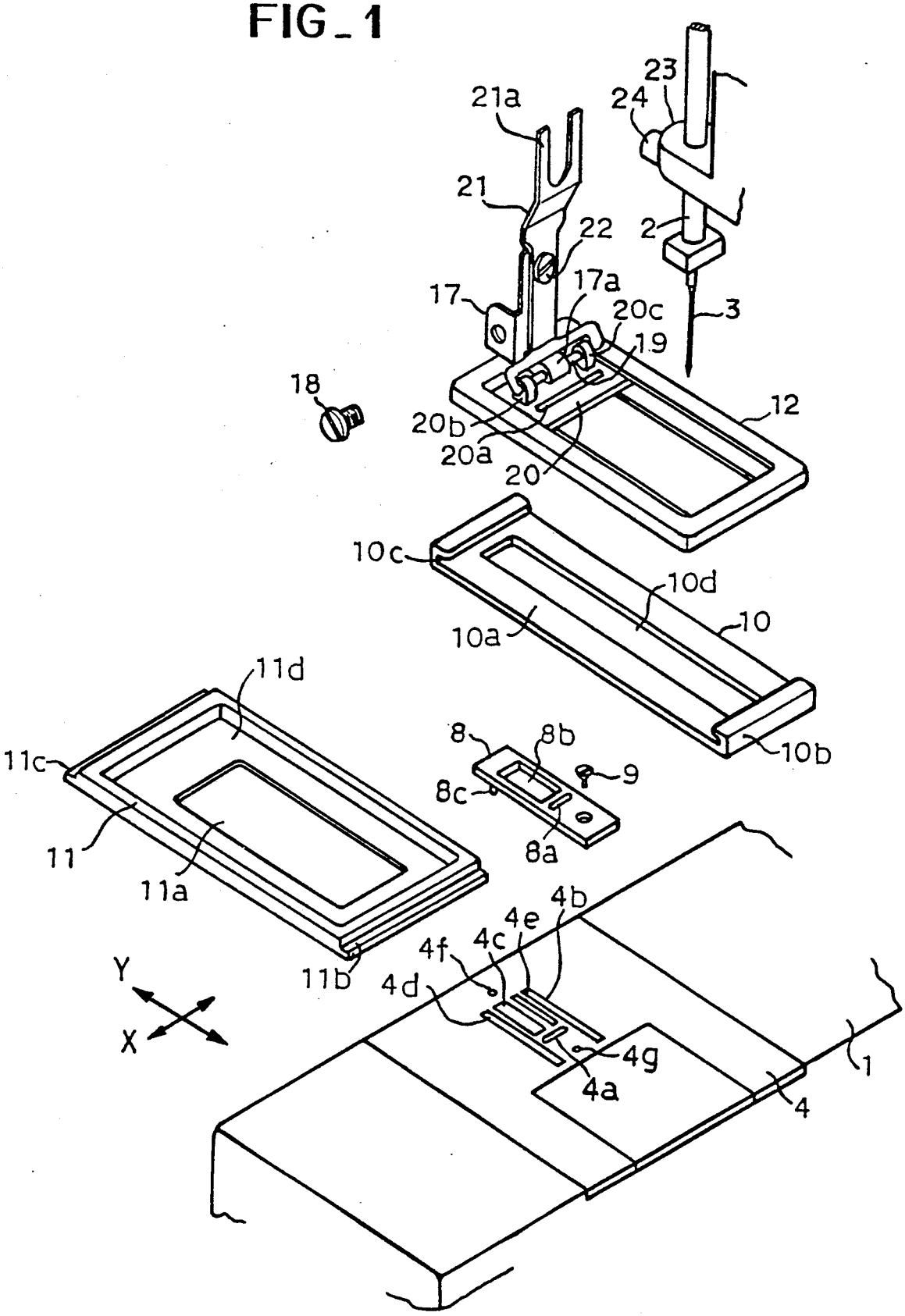
FIG. 1 is an exploded view of an embroidering machine of the invention.

The reference numeral 17 of FIG. 1 denotes a presser holder attached to the presser bar 15 by the screw 18 inserting into an opening 18*a*. The presser holder 17 is formed at the lower end with a supporter 17*a* such that a shaft 19 is moved in X-direction in support parts 20*b*, 20*c*. A presser guide plate 20 which is formed with a needle dropping hole 20*a* is moved in the X-direction.

An X-direction moving member 21 is rotatably supported by to a step portion of a stepped screw 22 at its center portion, and the screw part is fixed to the presser holder 17. The end portion of the X-direction moving member 21 is formed as a fork 21*d*, as seen in FIG. 2, so that the support parts 20*b*, 20*c* of the presser guide plate 20 are engaged with R parts 21*b*, 21*c* of the fork 21*d* due to a spring property of the fork 21*d*.

As seen in FIG. 1, the X-direction moving member 21 has a fork 21*a* at the other end holding the needle bar 2 movable vertically, and is connected to the needle amplitude stepping motor, mounting on a shaft 24 fixed integrally to a needle bar supporter 23 moving laterally in X-direction.

An upper frame 12 is so formed that it may be engaged with a guide 11*d* of the lower frame 11, and is formed at its inner both sides with square shaped grooves where the both ends of the presser plate 20 are movable.

Below, operation of the device will be described.

The lower work frame 11 is fitted with a fabric thereover, and the upper frame 12 connecting the presser holder 17 is moved down by the compression spring 14.

The back-forth movement of the fabric feed dog 5 is controlled by the feed adjuster connected to the feed adjusting stepping motor, the Y-direction driving member 10 is guided to the side of the small plate 8 to drive the lower frame 11 and the upper frame 12 in the Y-direction with respect to the presser plate 20.

The needle bar supporter 23 connecting to the needle amplitude stepping motor is moved right and left by the needle bar amplitude stepping motor so as to move right and left the X-direction driving member 21 engaging the shaft 24 mounted integral ly on the needle bar supporter 23 around the stepped screw 22.

The end point of the X-direction driving member 21 moves right and left the presser plate 20, and drives the upper and lower frames 12 and 11 in X-direction with respect to the needle guide plate 8.

A further explanation will be made with reference to the needle bar 2 supported by the needle bar supporter 23 and the fabric 12 held by the upper and lower frames 11 and 12.

Figure 3:
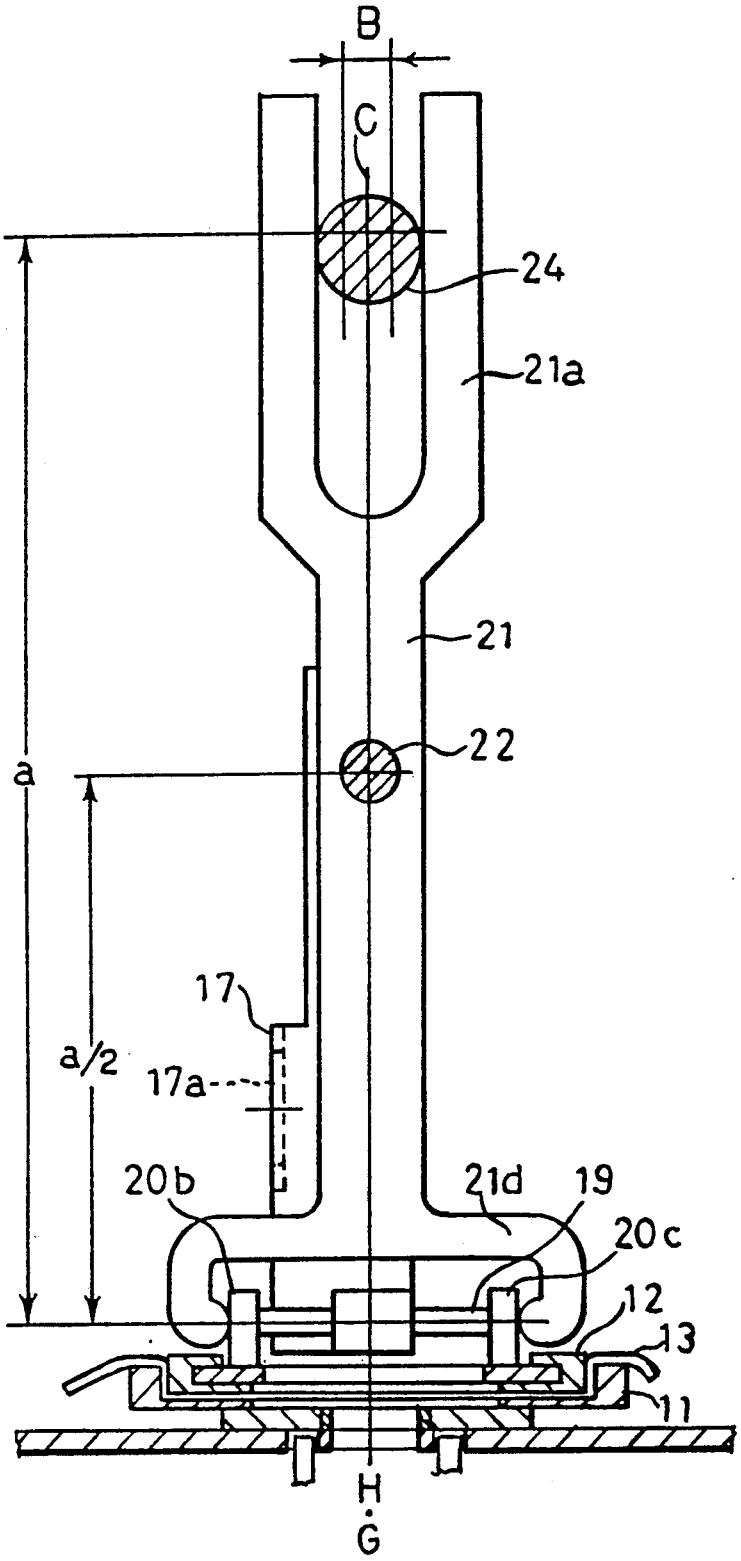
FIGS. 3 to 5 are exploded views of the embroidering device according to the invention in different actuation positions thereof.

A distance from the center of the shaft 24 to the center of the shaft 19 is a, and a distance from the center of the stepped screw 22 to the center of the shaft 19 is a/2. The needle dropping position is H, and the center of the upper frame 12 is G, so that they both agree with each other as shown in FIG. 3.

Figure 4:
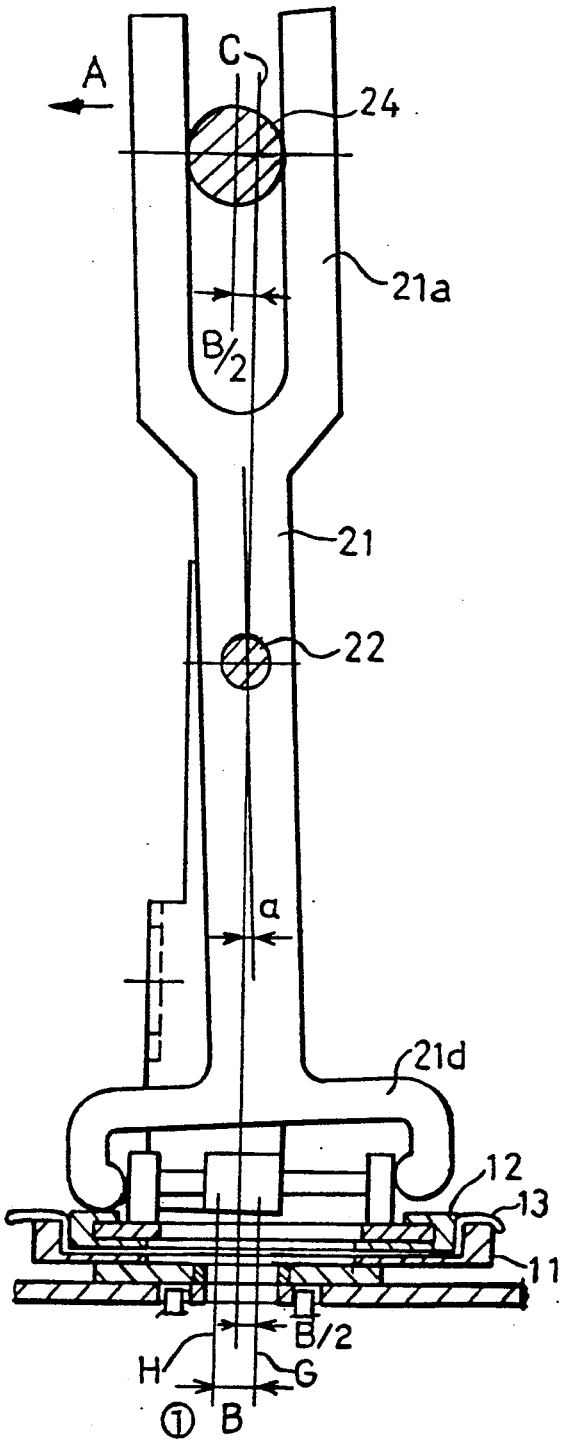

When the shaft 24 of the needle bar supporter 23 is, as seen in FIG. 4, driven from the center C of the amplitude in an arrow A direction by ½ of the maximum amplitude, the needle bar 2 is driven by B/2 in the same direction, and the X-direction driving member 21 is driven counterclockwise around the stepped screw 22 so as to move the fork 21*d* in a direction opposite to the arrow A, so that the upper frame 12, the lower frame 11 and the fabric 13 are driven by B/2 with respect to the Y-direction member 10.

Therefore, the relative position between the needle dropping position H and the center G of the upper frame, is moved by B.

Figure 5:
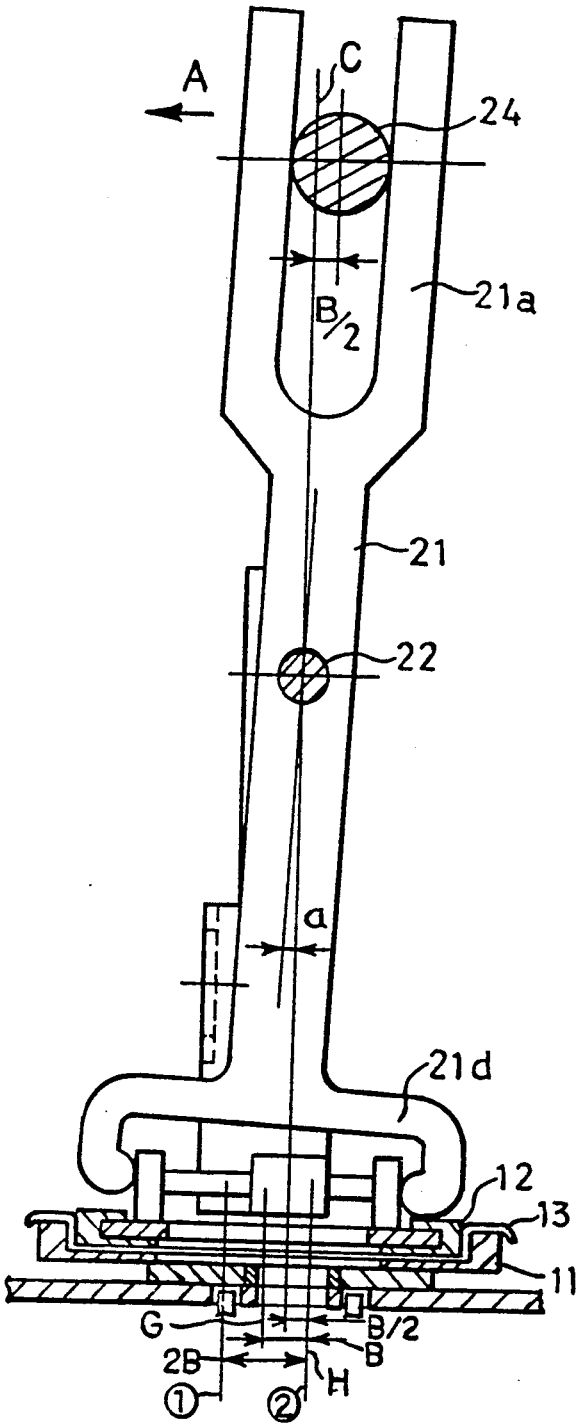

When the shaft 24 of the needle bar supporter 23 is, as seen in FIG. 5, driven from the center C of the amplitude in a direction opposite to an arrow A by ½ of the maximum amplitude, the needle bar 2 is driven by B/2 in the same direction, and the X-direction driving member 21 is driven clockwise around the stepped screw 22 so as to move the fork 21*d* in a direction of the arrow A, so that the upper frame 12, the lower frame 11 and the fabric 13 are driven by B/2 with respect to the Y direction piece 10.

Therefore, the relative position between the needle 3 and the fabric 13 is moved by B.

That is, since the upper frame 12, the fabric 13 and the lower frame 11 are moved in the opposite direction by the same amount as the amplitude of the shaft 24 of the needle bar supporter 23, the amplitude of the needle is enlarged twice.

Since the end points of the X-direction driving member 21 maintain the contact for lateral moving by engaging the support parts of the presser plate 20 under a condition that the X-direction driving member is rotated around the stepped screw 22, the present embodiment shows the R shape, but the contact may depend upon a rotor.

The present embodiment shows that the stepped screw 22 is positioned at the intermediate place between the center of the shaft 24 mounted on the needle bar supporter 23 so as to make the amplitude twice, and it is possible to make the amplitude larger by bringing the stepped screw 22 near the shaft 24, or to make it smaller by bringing the screw 22 near the shaft 19.

Further, the presser holder 17 is formed with several screwing holes, and in response the X-direction driving member 12 is also formed with several holes so that a desired magnification of the amplitude may be provided.

This embodiment shows that the small plate 8 is fixed to the needle plate 4 for moving the Y-direction driving member 10 with respect to the needle dropping hole 4*a*, and the lower frame 11 formed with the long groove 10*d* is movably fitted.

The driving piece 10 is moved by feed dogs 5. As it is generally known, a feed dog is moved substantially along the locus of parallelogram to transport a fabric to be sewn relative to a vertically reciprocating needle in cooperation with a presser foot which presses a fabric against a needle plate and the feed dog accordingly. In short, the feed dog transports the fabric when the feed dog moves in a horizontal plane above the needle plate where the feed dog engages the fabric which is pressed against the feed dog by the spring biased presser foot.

Figure 2:
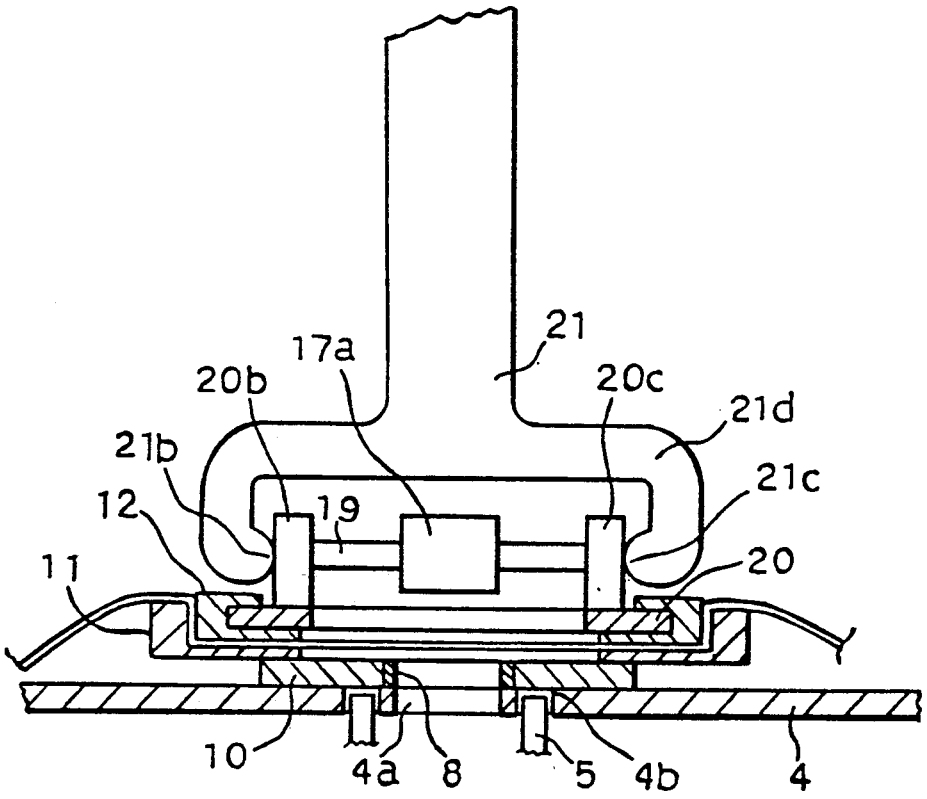
FIG. 2 is a partial cross sectional view of the embroidering machine, according to the invention.
Figure 7:
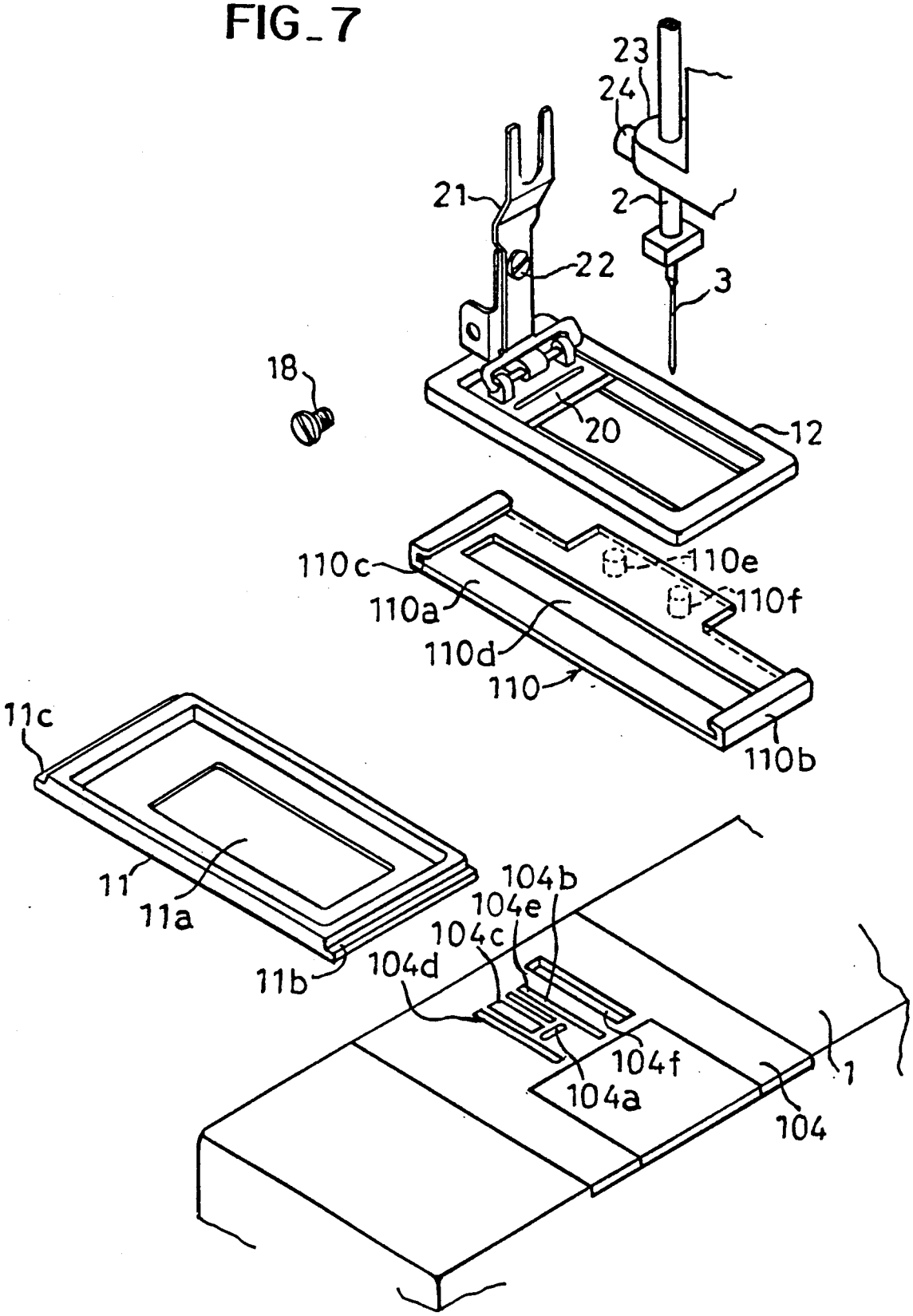
FIG. 7 is an exploded view of an embroidering device with embroidering frames of another embodiment according to the invention.

With reference to FIGS. 1 and 2, the drive piece (elongate plate) 10 is moved by the feed dogs 5 in the Y-direction along the guide plate 8, since the elongate plate 10 is placed on the needle plate 4 and is engaged by the feed dogs when the latter are moved in the horizontal plane above the needle plate and since the elongate plate 10 is pressed against the needle plate by the presser plate 20 by the fabric holed (11, 12) which is slidably mounted on the presser plate 20 and engages the elongate plate. The guide in the Y-direction is also possible by the embodiment shown in FIG. 7.

That is, a needle plate 104 is formed with a guide groove 104*f* in parallel with the feed (Y)-direction of the fabric feed dog 5, and a Y-direction driving piece 110 is formed with standing parts 110*b*, 110*c* bent inwardly in square, and further the guide plate 110 is formed with a pair of pins 110*e*, 110*f* fitting into the guide groove 104*f* in parallel with an oblong groove 110*d* but in opposition to the standing parts 110*b*, 110*c*.

If the pair of pins 110*e* and 110*f* are fitted into the guide groove 104*f*, the Y-direction driving member 110 is moved in the Y-direction by the feeding action of of fabric feed dog 5.

While the invention has been illustrated and described as embodied in an embroidering device of a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An embroidering device for a sewing machine including a frame, stitch forming means comprising a vertically reciprocating and laterally swinging needle bar and a needle attached to a lower end of the needle bar, a needle plate attached to the sewing machine frame, a presser bar having a presser foot attached to a lower end thereof for pressing a fabric to be sewn against the needle bar, and a feed dog movable in synchronism with a vertical movement of the needle bar to transport, in cooperation with the presser foot, a fabric to be sewn in a direction transverse to lateral swinging and vertical reciprocating directions of the needle bar, said embroidering device comprising:

first guide means associated with the needle plate of the sewing machine;

first drive means to be supported on the needle plate of the sewing machine and comprising a first elongate member engaging said first guide means and to be connected with the feed dog for displacement thereby relative to said first guide means in the direction in which the fabric to be sewn is transported;

second drive means comprising a second elongate member having an intermediate part to be pivotally supported on the presser bar, an upper end to be operatively connected to the needle bar, and a lower end;

second guide means supported at said lower end of said second elongate member; and fabric expanding means connected with said first elongate plate for movement therewith relative to said second guide means and for movement relative to said first elongate plate in the lateral swinging direction of the needle bar.

2. An embroidering device as set forth in claim 1, wherein said first guide means comprises a rectangular plate having a needle dropping opening, said first elongate plate having a longitudinal rectangular opening for receiving said rectangular plate therein.

3. An embroidering device as set forth in claim 1, wherein said first guide means comprises an elongate groove formed in the needle plate and said first elongate plate has a plurality of pins for engagement with said elongate groove.

* * * * *